US006003693A

United States Patent [19]

Blickenstaff

[11] Patent Number: 6,003,693

[45] Date of Patent: Dec. 21, 1999

[54] COMBINED BOTTLE HOLDER AND BOTTLE

[76] Inventor: Rodney D. Blickenstaff, 9026 Plaza Park Dr., Elk Grove, Calif. 95624

[21] Appl. No.: 09/075,207

[22] Filed: May 11, 1998

[51] Int. Cl.[6] ..... A47F 7/00

[52] U.S. Cl. ..... 211/74; 248/311.2; 248/312; D7/619; D9/430

[58] Field of Search ..... 211/74; 248/312, 248/311.2; D7/619; 294/137; D9/430

[56] References Cited

U.S. PATENT DOCUMENTS

| | | | |
|---|---|---|---|
| D. 373,531 | 9/1996 | Cooksey | D9/430 |
| D. 394,209 | 5/1998 | Millet | D9/430 |
| 5,180,066 | 1/1993 | McArdle | 211/74 |
| 5,197,612 | 3/1993 | Thomson | 211/74 |
| 5,381,907 | 1/1995 | Stukuls | 211/74 |
| 5,472,098 | 12/1995 | Ho | 211/2 |
| 5,558,236 | 9/1996 | Williams et al. | 211/74 |
| 5,624,043 | 4/1997 | Baptista | 248/312 X |

*Primary Examiner*—Robert W. Gibson, Jr.
*Attorney, Agent, or Firm*—Patent & Trademark Services; Thomas Zack; Joseph H. McGlynn

[57] ABSTRACT

A bottle rack assembly having bottom, front, rear and two side panel members joined together to form the assembly. The bottom and rear panel members having substantially flat outer surfaces with the rear panel forming an inclined angle greater than ninety degree with respect to the bottom flat surface. The front panel member has a height which is generally perpendicular to the joined bottom panel member and has an upper hole for receiving the neck of a bottle. Two abbreviated height side panel members are joined to said bottom panel and to edges of the front and rear panel members partially along their respective heights. The side panel members join the rear panel member at an inclined angle which is the same as the inclination between the bottom and rear panel. A carrying handle extending from and joining the upper end portions of the rear and front panels with a reduced thickness mid section may be used to carry the assembly or when pouring a liquid such as wine from the bottle retained by the assembly.

2 Claims, 1 Drawing Sheet

COMBINED BOTTLE HOLDER AND BOTTLE

BACKGROUND OF THE INVENTION

The storing of large corked bottles, such as wine bottles, in refrigerators or other confined storage spaces may pose a problem when the bottle's height is too tall to sit upright. In such situations, the previously uncorked bottle in placed on its side in the storage compartment with the reinserted cork facing in the same side wise direction. With this side orientation of the bottle and its cork, it is not unusual for leakage to occur from the corked opening resulting in a loss of the stored liquid and a mess in the storage compartment.

The present invention relates to a unique bottle mounting assembly that may be stored in a confined spaced having a storage compartment less than the height of the bottle in which the bottle is maintained at an inclined angle to prevent leakage through its corked opening and which may be placed upright on its flat backing assembly member on a flat surface for uncorking as detailed hereafter.

DESCRIPTION OF THE PRIOR ART

Bottle holding racks and assemblies come in a great variety of styles and configurations. For example, in U.S. Pat. No. 5,180,066 to McArdle a one-piece bottle rack for the horizontal storage and display of long-necked bottles is disclosed having a planar base member and an integral inclined ramp member with spaced holes.

In the Thomson reference (U.S. Pat. No. 5,197,612) the bottle stand is X-shaped and has two perpendicularly oriented legs with one or more holes in the legs to receive the necks of bottles.

The Ho patent (U.S. Pat. No. 5,472,098) discloses a multipurpose book rack that can be used to store inclined bottles.

In the Williams et al. invention (U.S. Pat. No. 5,558,236) an inclined planar rod loop with an opening extends from a base with the loop being used to hold the neck of a bottle.

The present invention relates to bottle rack assembly having a substantially flat base member, an inclined substantially flat back member on which the bottom of the stored bottle rests, a carrying handle and a front member with an upper opening hole to receive the neck of the bottle all as more fully set forth in this specification.

SUMMARY OF THE INVENTION

This invention relates to bottle rack assembly in which an inclined bottle may be stored in a confined compartment whose height is less than the length of the bottle to be stored.

It is the primary object of the present invention to provide for an improved bottle rack assembly.

Another object is to provide for such an assembly wherein the stored bottle's height is disposed at and incline and has a height less than the compartment height in which stored.

These and other objects and advantages of the present invention will become apparent to readers from a consideration of the ensuing description and the accompanying drawings.

DESCRIPTION OF THE PREFERRED EMBODIMENT

Figure 1:
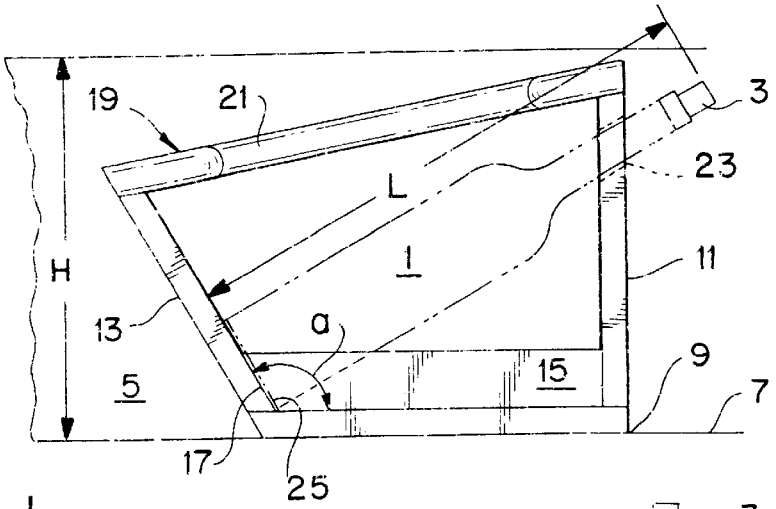
FIG. 1 is a side view of the invention's preferred embodiment with an inclined bottle in a stored position.

FIG. 1 is a side view of the invention's preferred embodiment with an inclined bottle 1 in a stored position. The bottle, in this embodiment a wine bottle, has a cork 3 that has previously been removed and then reinserted by the user in the bottle's neck opening. As shown, the overall length L (or height if in an upright vertically disposed position) of the bottle including its inserted cork is greater than the height H of the storage compartment 5, partially shown. The storage compartment 5 could be the shelf inside of a refrigerator where a bottle of wine is being stored or it could be any other type of storage compartment where bottles can be stored such as a shelf in a storage room. Forming part of the storage compartment is the lower generally flat floor member 7 on which the flat bottom 9 of the bottle rack assembly rests.

Fixed to the bottom 9 is a front panel member 11, a back panel member 13 and two opposite upright side members 15, one of which is shown in this view. The front panel member 11 is approximately perpendicular to the bottom panel member 9. Both side members 15 also are fixed to the front and back panel members and have upwardly and rearwardly inclined rear edge surfaces 17 where they join the back panel member. This inclination from the flat bottom panel 9 has an angular measurement greater than ninety degrees when measured from the flat bottom panel to the side edge surfaces l7 by the angle a, as shown.

In a similar manner the back panel member 13 is also inclined with respect to the flat bottom panel 9 with the same angular inclination as the rear portions of the edge sides 17. This angular measurement is also greater than ninety degrees when measured from the bottom panel to the surface of the rear panel 13 and is defined by the same angle a. In the illustrated embodiment the inclination for the angle a was measured as a little more than 130 degrees.

Joining and spanning the distance between the upper end portions of the back and front panel members 11 and 13 is a carrying handle 19 with a reduced mid portion thickness portion 21. The front panel member 11 has an upper panel bottle neck receiving hole 23 (best shown in FIG. 3) through which the bottle's neck and cork may pass and rest upon its defined circular border outline. When so resting, the bottle 1 is maintained in an inclined position as in FIG. 1 with the bottle's flat bottom 25 resting against the interior side of the flat inclined rear panel member 13. If the angle a were about 130 degrees, the inclination of a center line running the length of the bottle 1 with 1 is maintained in an inclined position as in FIG. 1 with the bottle's flat bottom 25 resting against the interior side of the flat inclined rear panel member 13. If the angle a were about 130 degrees, the inclination of a center line running the length of the bottle 1 with respect to the flat bottom 9 and the flat compartment surface 7 on which this bottom rests would be about 90 degrees less or 40 degrees. This inclination of the retained bottle insures the force of gravity will not be acting of the stored liquid in the bottle against the reinserted cork which considerably lessens the likelihood the bottle's liquid will leak from the bottom through the cork.

Figure 2:
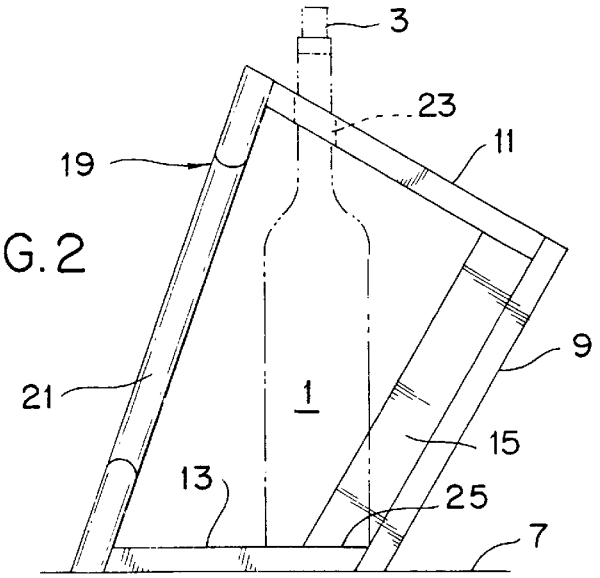
FIG. 2 is a side view of of the FIG. 1 bottle rack assembly in an upright position when desired to uncork the bottle.

FIG. 2 is a side view of the FIG. 1 bottle rack assembly in an upright position such as when a user desires to uncork the bottle. To provide a stable working arrangement the two flat surface of the back panel 13 and the bottle's bottom 25 bear against each other and the exterior surface of panel 13 rests on the flat generally horizontal working surface 25 such as a table top, counter, or floor. While in this stable position, a user may easily insert a cork opener into the cork 3 to withdraw it from the bottle.

Figure 3:
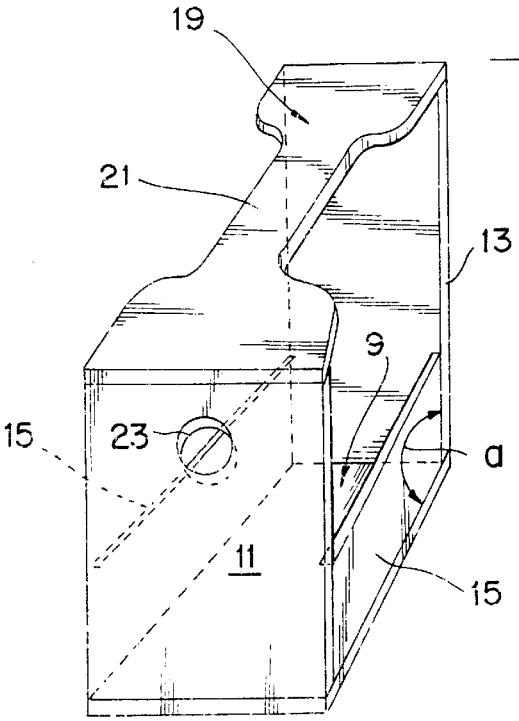
FIG. 3 is a front perspective view of of the FIG. 1 bottle rack assembly without the stored bottle.

FIG. 3 is a front perspective view of of the FIG. 1 bottle rack assembly without the stored bottle. The assembly's front panel 11 has the upper bottle receiving hole 23, previously mentioned, used to retain the bottom within the assembly in an inclined position. The bottom member 9 is joined to the two identical side panel members 15 which have abbreviated heights. By making them so sufficient opened side space is provided so that the bottle 1 may easily be inserted into or removed from the assembly for storage, carrying or disposal. The reduced handle area 21, where a user grabs the handle 19 with their hand to lift and move the assembly or to pour the liquid from the uncorked bottle while in the assembly, is also more clearly shown in this view.

Variations are contemplated to the preferred embodiment. A logo or other wording may be imprinted upon one or both of the sides panels l5 to distinguish one assembly from another or to advertise a product or service. The panels for the sides, front and rear should be made of a decorative material which is aesthetically pleasing, such as kiln dried finished redwood. To reduce weight plastics may also be used for the assembly and its several panel members.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. The combination of a bottle rack assembly and bottle comprising:

a bottom rack panel member having a substantially flat surface;

a front rack panel member having a height and being attached to said bottom rack panel in a generally perpendicular direction, said front rack panel member having an upper through hole for receiving a neck of a bottle;

a rear rack panel member having a substantially flat surface and a height, said rear rack panel being mounted on said bottom rack panel member at an inclined angle greater than ninety degrees as measured from the flat bottom rack panel;

two side rack panel members joined to said bottom rack panel and to said front rack panel and said rear rack panel member along their heights, said side rack panel members joining said rear rack panel member at an inclined angle which is substantially the same as the angular inclination between the bottom rack panel and said rear rack panel member, said two side rack panel members each having a vertical height which is substantially less than the heights of the rear rack panel member and the front rack panel member to which joined to permit a bottle to be inserted or removed from the rack assembly formed by the bottom rack panel, the front rack panel, the rear panel rack, and the side rack panels; and a bottle capable of holding a liquid having a neck with a corkable front end, said bottle having a flat rear bottom surface which when inserted into the formed rank assembly bears directly against the rear substantially flat surface of the rack panel member, said bottle also having a length extending from the bottle's flat bottom to the bottle's corkable front end, whereby the neck of said bottle can be inserted into said upper hole of the front rack panel for receiving the bottle in the formed rack assembly.

2. The combination of claim 1 wherein the inclined angle between the rear rack panel and the bottom rack panel is about 130 degrees.

* * * * *